US008239997B2

(12) United States Patent
Lin

(10) Patent No.: US 8,239,997 B2
(45) Date of Patent: Aug. 14, 2012

(54) MOP STRAINER

(76) Inventor: Ching-Chun Lin, Su-Ao Township, Yilan County (TW)

( * ) Notice: Subject to any disclaimer, the term of this patent is extended or adjusted under 35 U.S.C. 154(b) by 322 days.

(21) Appl. No.: 12/766,061

(22) Filed: Apr. 23, 2010

(65) Prior Publication Data

US 2011/0185532 A1 Aug. 4, 2011

(30) Foreign Application Priority Data

Jan. 29, 2010 (TW) ..... 99201905 U

(51) Int. Cl.
*A47L 13/58* (2006.01)

(52) U.S. Cl. ..... 15/260; 15/264; 34/58; 210/360.1

(58) Field of Classification Search ..... 15/260, 15/263, 264; 35/58; 68/241; 210/360.1, 210/361

See application file for complete search history.

(56) References Cited

U.S. PATENT DOCUMENTS 7,743,528 B2 * 6/2010 Lin ..... 34/58
8,028,369 B2 * 10/2011 Chiang ..... 15/260
8,056,179 B2 * 11/2011 Hsu ..... 15/260
8,065,777 B2 * 11/2011 Lin ..... 15/260
2010/0242205 A1 * 9/2010 Chen ..... 15/263
2010/0287724 A1 * 11/2010 Hsu ..... 15/260
2010/0306952 A1 * 12/2010 Chu ..... 15/260
2011/0154607 A1 * 6/2011 Chen ..... 15/260

* cited by examiner

*Primary Examiner* — Brian Glessner
*Assistant Examiner* — Adriana Figueroa
(74) *Attorney, Agent, or Firm* — C. G. Mersereau; Nikolai & Mersereau, P.A.

(57) ABSTRACT

A mop strainer has a bucket, a driving unit, a transmission unit and a draining unit. The driving unit and the transmission unit are received in a pedal mount of the mop strainer. The driving unit and the transmission unit are driven by stepping on the driving unit, so as to rotate the draining unit and drain a mop. The driving unit has a reinforced sector wall and a limit slot to limit the stroke in operation. The draining unit has a water guard to prevent drained water from sputtering out and the water guard further has a mop gripper for holding the mop. Given all these features, the present invention is more robust and can be operated and stored more conveniently and practically.

16 Claims, 8 Drawing Sheets

MOP STRAINER

BACKGROUND OF THE INVENTION

1. Field of the Invention

The present invention is related to a mop strainer, and more particularly to a mop strainer extracting water with centrifugal force.

2. Description of the Related Art

Draining a mop is a painstaking job. If a mop is not fully drained, a floor mopped thereby could be left wet and slippery. People walking on a wet floor may easily slip and fall, sometimes, such risk may be life-threatening.

To improve draining efficiency, a conventional pail for a mop has a bucket, a driving unit, a transmission unit and a draining unit. The bucket has a chamber for receiving the driving unit. The driving unit has a base fixedly mounted on the bucket. A movable member pivotally reciprocating and a transmission member controlled by the movable member are mounted on the base. A pedal is formed on one side of the movable member for a user to step on. An arced rack is stretched over a rear surface of the pedal, and a free end of the arced rack is not connected with the pedal. The transmission unit has a pinion gear, a first bevel gear and a second bevel gear. The pinion gear is engaged with the arced rack. The first bevel gear is coaxially fixed with the pinion gear. The second bevel gear is engaged with the first bevel gear. The draining unit supports a mop and is located inside the bucket. The draining unit has a pivot shaft the free end of which is pivotally mounted in the second bevel gear and is pivotally mounted on the base. When the pedal is stepped on, the pinion gear is driven by the arced rack to drive the first bevel gear and the second bevel gear. Therefore, the mop is drained by rotating the draining unit.

The arced rack of the movable member and the pedal forms an L-shaped structure, and a cantilever beam design is adopted for the arced rack. All these make the entire structure flimsy. During operation, the arced rack is prone to fracture and damage shortening the life duration of the pail of mop. Besides, the free end of the arced rack and the pedal forms an open mouth, and the movable member has no definite limiting structure when returning so the pedal is located at different heights so visual confirmation before stepping on the pedal is required, which reduces efficiency of use or may cause a cleaner to miss the pedal and slip, causing possibility of an injury. Moreover, after finishing the floor cleaning, the mop is laid aside or stored. Users usually lean the mop handle against a wall. However, the mop easily gets slanted or falls down, thereby easily causing people to stumble or trip. Such conventional pail for a mop is certainly inconvenient to use.

SUMMARY OF THE INVENTION

An objective of the present invention is to provide a mop strainer having a robust structure and convenient operation.

To achieve the foregoing objective, the mop strainer has a bucket, a driving unit, a transmission unit and a draining unit.

The bucket has a chamber and a pedal mount. The chamber serves to receive water. The pedal mount is formed in the bucket.

The driving unit is mounted inside the pedal mount and has a base, two erect wings and a reciprocating pedal. The base is fixedly mounted on the bucket. The two erect wings are mounted in parallel on the base. The reciprocating pedal has a sector wall, a limit slot, a recess, multiple reinforced ribs, an arced rack and a foot rest. The sector wall has two bevel edges. The limit slot is formed through the sector wall. The recess is formed in one side of the sector wall. The multiple reinforced ribs are formed on the recess. The arced rack is formed on a bottom of the recess of the sector wall and beneath the limit slot. The foot rest horizontally extends from one of the two bevel edges of the sector wall and has a first end pivotally mounted on the two erect wings.

The transmission unit is received inside the pedal mount, located within the base, the reciprocating pedal and one erect wing, and has a gear assembly engaging the arced rack of the driving unit.

The draining unit is fixedly connected to the second bevel gear, driven thereby to rotate unidirectionally, and has a rod, a basket and a water guard. One end of the rod is sleeved by the unidirectional bearing of the second bevel gear. The basket is received in the chamber of the bucket and has a ring wall, and a bottom of the basket is centrally fixed with the other end of the rod and is unidirectionally rotated by the second bevel gear. The water guard is located in the chamber of the bucket, externally surrounds a segment of the ring wall of the basket facing a portion of an inner wall of the bucket above the pedal mount, and has a mop gripper extending from a periphery of the water guard opposite to the basket.

Given the structure of the sector wall and the foot rest, the reciprocating pedal is limited to rotate in a range defined by the limit slot and is also limited to move axially. Besides, the sector wall has multiple reinforced ribs therein. Therefore, the present invention is operated in a controlled range without excessive wearing of the arced rack and damaging the sector wall. Such limiting structure also positions the reciprocating pedal constantly at a same location, facilitating repeated operation. Besides, the water guard having a mop gripper fixes the mop after finishing the use of the mop and prevents the mop from falling down and stumbling passers-by.

DETAILED DESCRIPTION OF THE INVENTION

Figure 1:
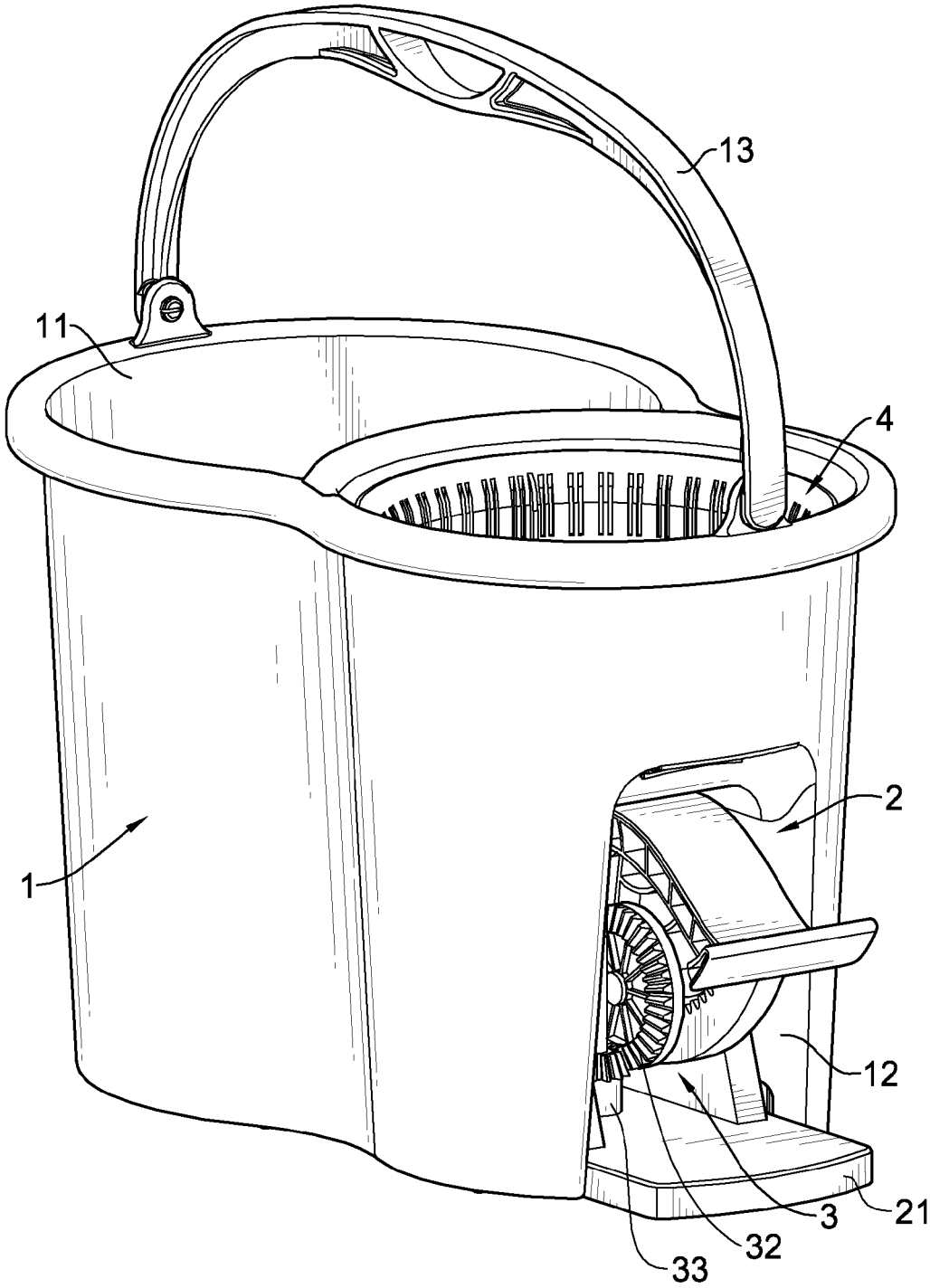
FIG. 1 is a perspective view of a mop strainer in accordance with the present invention.
Figure 2:
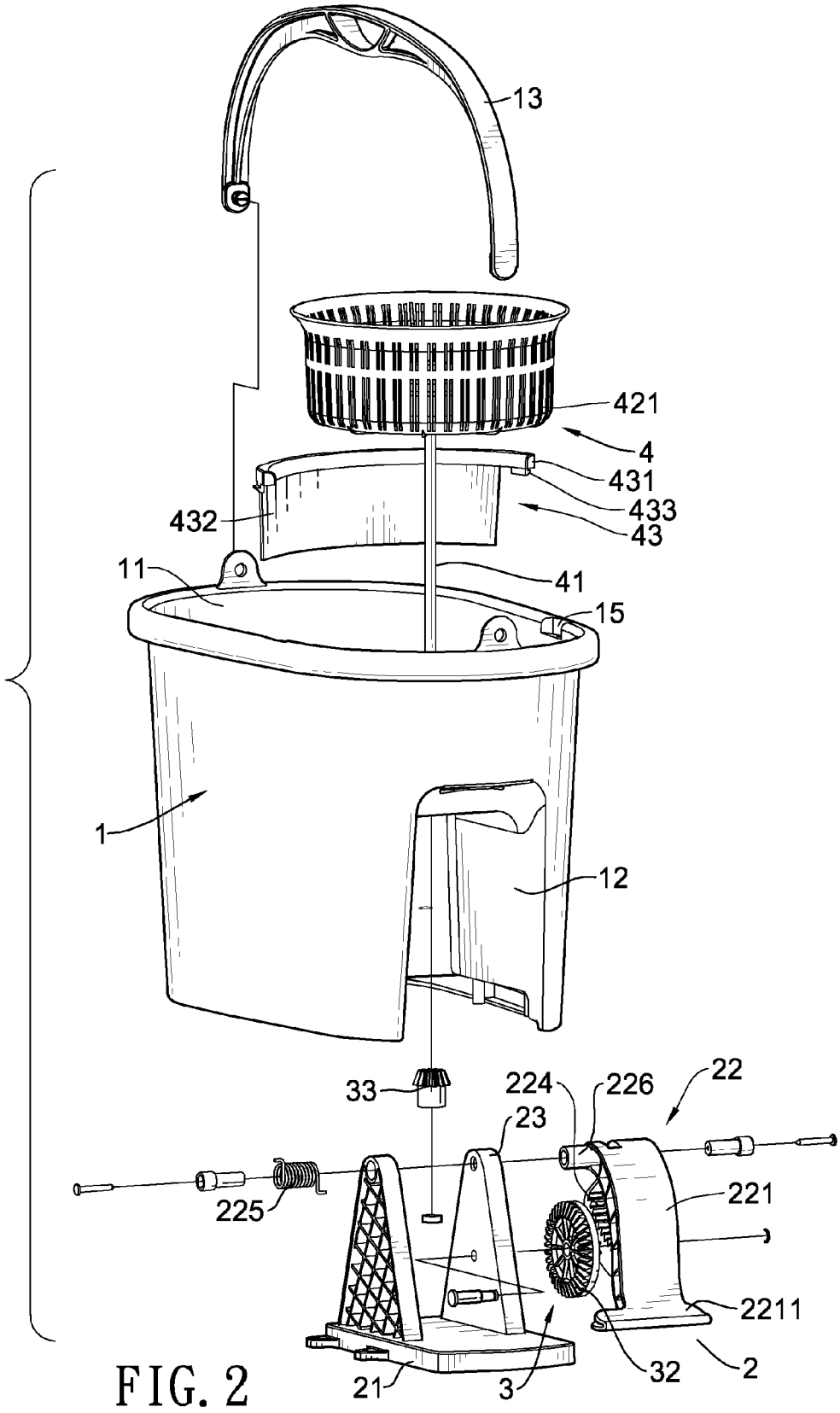
FIG. 2 is an exploded perspective view of the mop strainer in FIG. 1.
Figure 3:
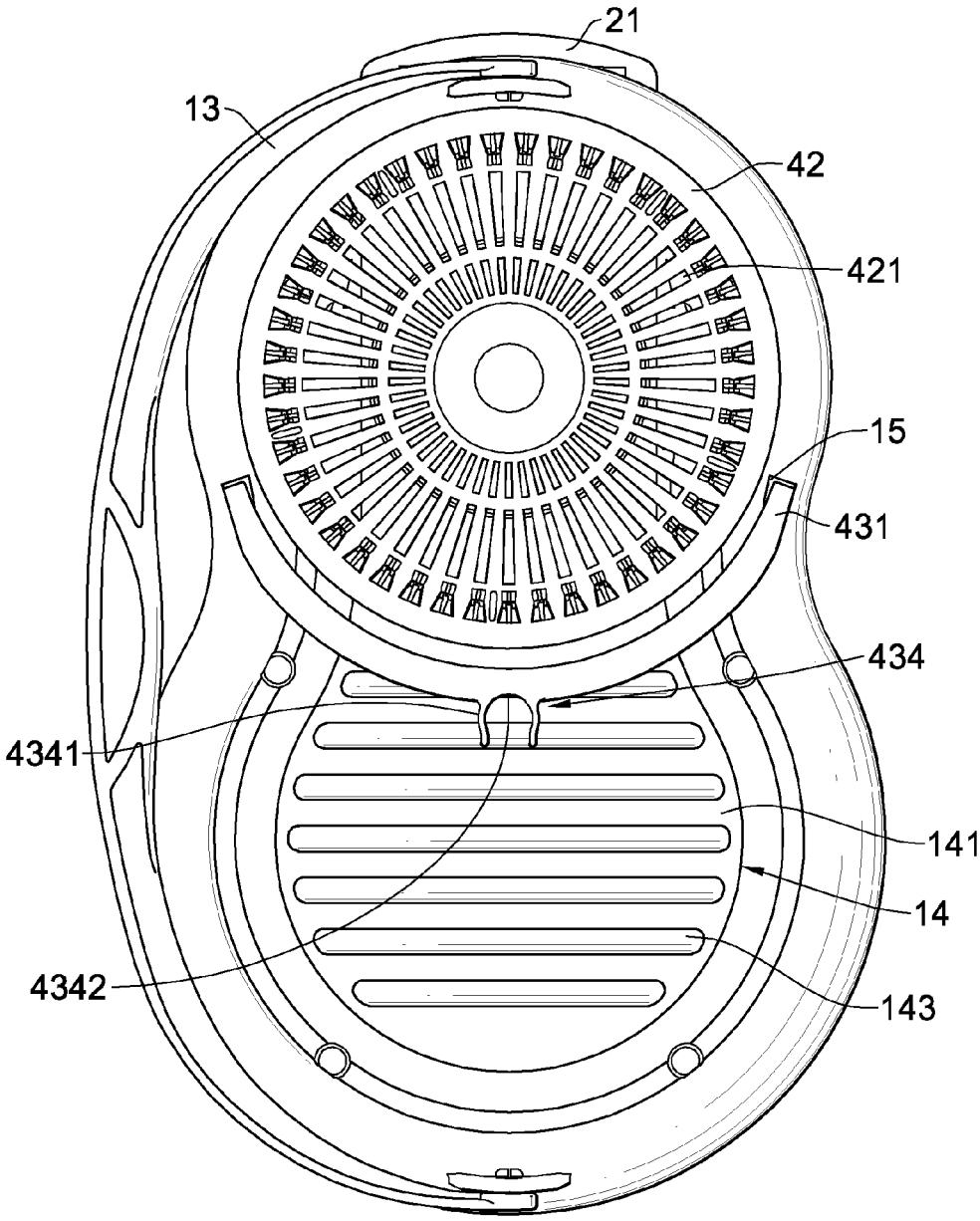
FIG. 3 is a top view of the mop strainer in FIG. 1.

With reference to FIGS. 1 to 3, a mop strainer of the present invention has a bucket (1), a driving unit (2), a transmission unit (3) and a draining unit (4).

The bucket (1) is used to contain the water drained from a mop and has a chamber (11), a pedal mount (12), a handle (13), a bottom board (14) and two recesses (15).

Figure 6:
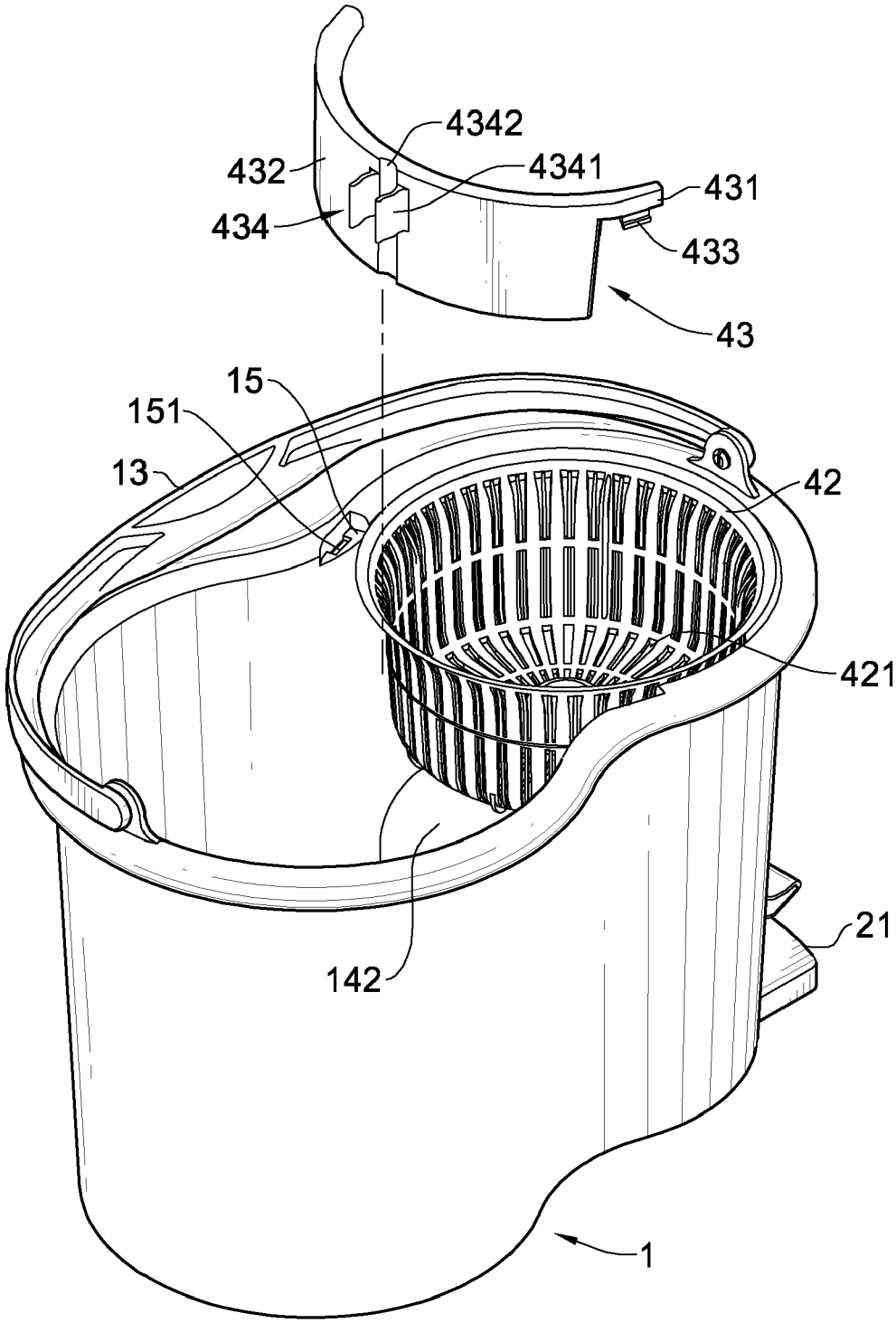
FIG. 6 is a partially exploded perspective view of the mop strainer in accordance with the present invention.

The chamber (11) is defined in the bucket (1) and serves to accommodate water. The pedal mount (12) is a recess formed into the bucket (1) for receiving the driving unit (2), the transmission unit (3) and a part of the draining unit (4). The handle (13) has two ends pivotally mounted on a top edge of the bucket (1) for lifting the bucket (1). The bottom board (14) is a bottom of the bucket (1) and has an uneven portion (141) and a raised portion (142). With reference to FIG. 6, the raised portion (142) is raised above the uneven portion (141) and is located directly above the pedal mount (12). Multiple parallel ribs (143) are formed on the uneven portion (141) of the bottom board (14). The two recesses (15) are formed on two opposite top edges of the bucket (1) and have two snap holes (151) formed respectively therein.

The driving unit (2) is mounted inside the pedal mount (12) and has a base (21), a reciprocating pedal (22) and two erect wings (23).

The base (21) is fixedly mounted inside the pedal mount (12) of the bucket (1). The two erect wings (23) are mounted on the base (21) in parallel.

Figure 4:
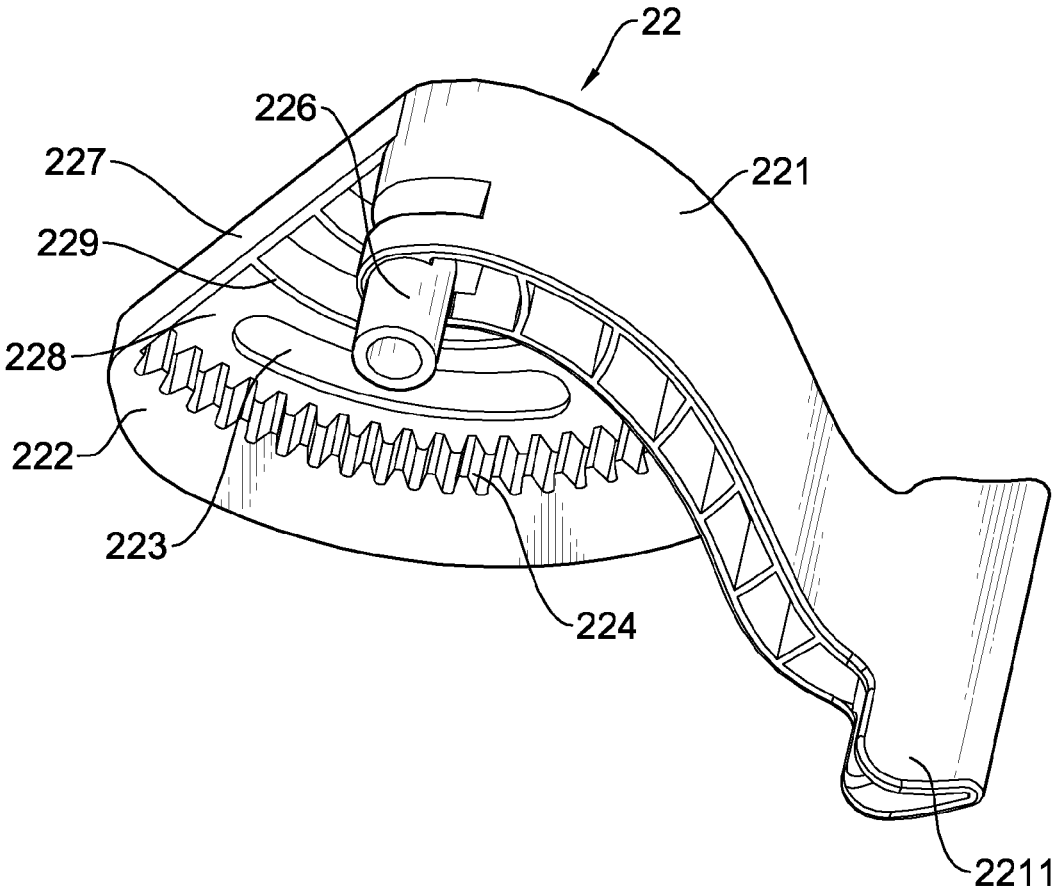
FIG. 4 is a perspective view of a reciprocating pedal of the mop strainer in accordance with the present invention.

With further reference to FIG. 4, the reciprocating pedal (22) is pivotally mounted on tops of the two erect wings (23) on the base (21) and has a foot rest (221), a sector wall (222), a limit slot (223) and an arced rack (224). The sector wall (222) has two bevel edges (227) and a recess (228) formed in one side thereof. The limit slot (223) is formed through the sector wall (222). The arced rack (224) is formed at a bottom of the recess (228) of the sector wall (222) and is located beneath the limit slot (223). The foot rest (221) horizontally extends from a bevel edge (227), takes a wavy form, and has a first end pivotally mounted to tops of the two erect wings (23) and a second end limiting the foot rest (221) to move in an axial direction. To enhance strength of the sector wall (222) and resist stepping pressure, multiple reinforced ribs (229) are added therein.

The reciprocating pedal (22) further has a torsion spring (225) and a pivot shaft (226). The pivot shaft (226) axially extends from the first end of the foot rest (221), is sleeved by the torsion spring (225), and pivotally and respectively mounted in the two erect wings (23), so that the torsion spring (225) is respectively urged against the reciprocating pedal (22) and one of the erect wings (23). The second end of the foot rest (221) takes a form of a T-shaped tail (2211) to limit the reciprocating pedal (22) to move axially.

Figure 5:
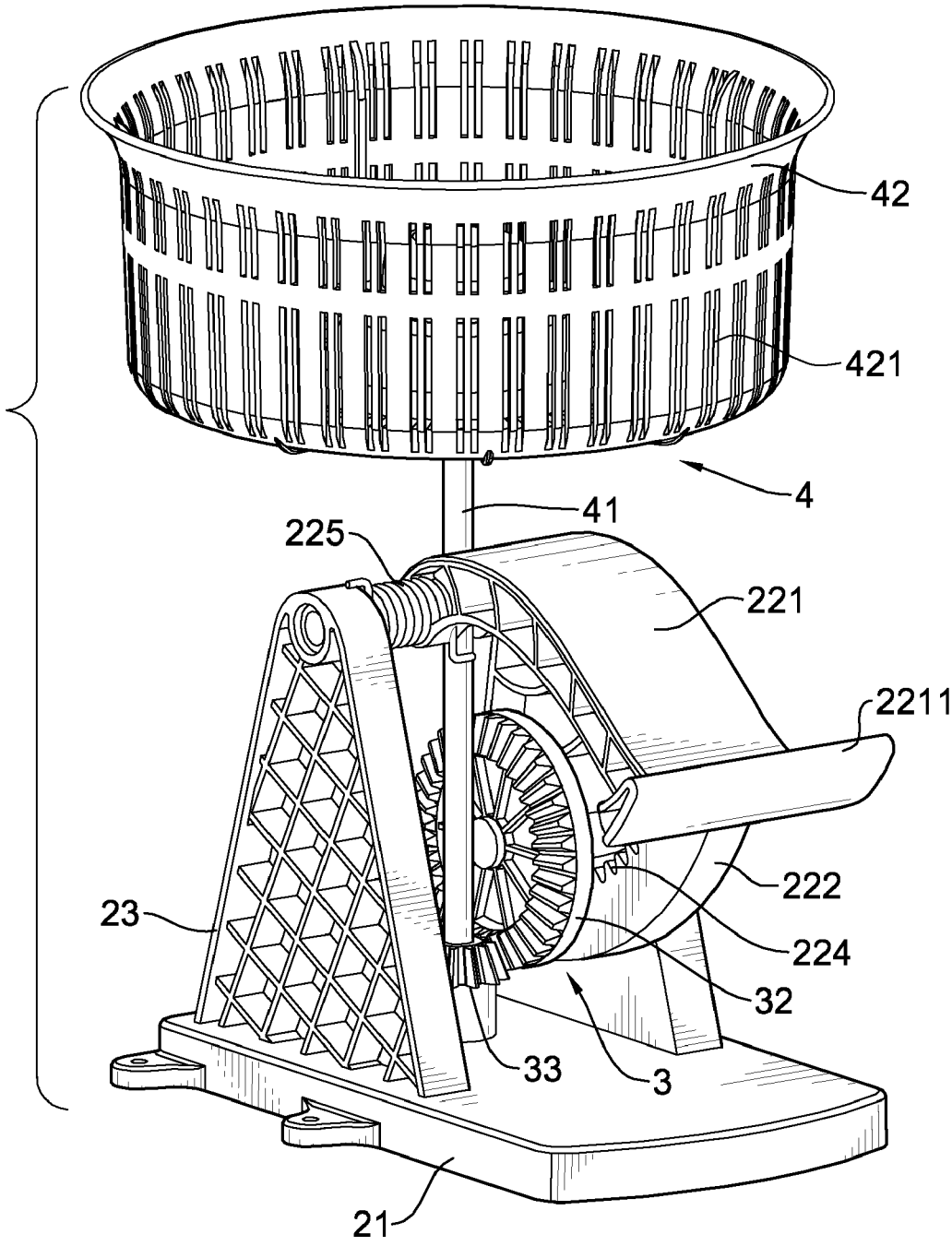
FIG. 5 is a perspective view of a driving unit, a transmission unit and a draining unit of the mop strainer in accordance with the present invention.
Figure 7:
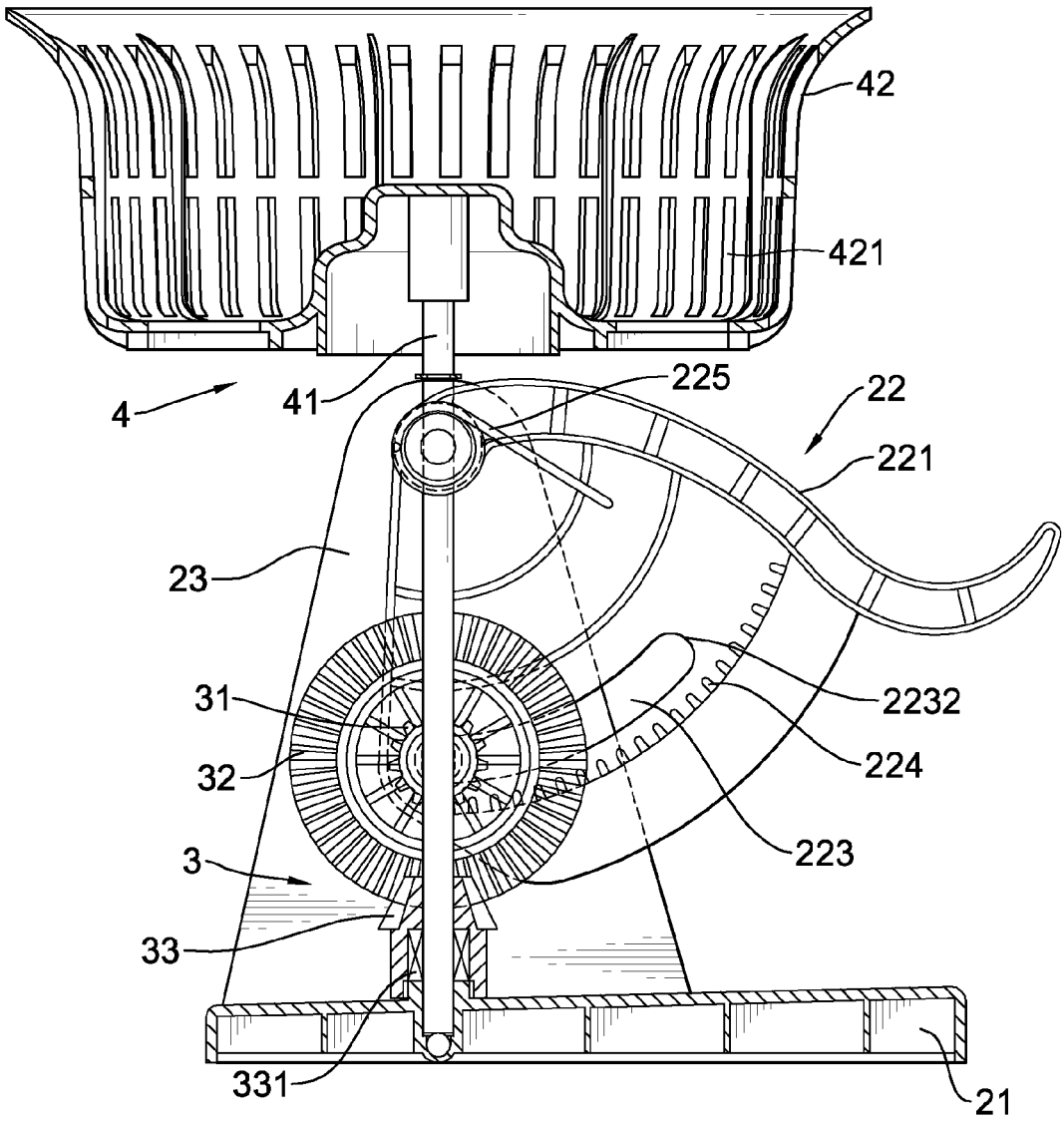
FIG. 7 is a side view of the driving unit, the transmission unit and the draining unit of the mop strainer in accordance with the present invention with hidden features shown in phantom lines.

With reference to FIGS. 5 and 7, the transmission unit (3) has a pinion gear (31), a first bevel gear (32) and a second bevel gear (33). The pinion gear (31), the first bevel gear (32) and the second bevel gear (33) are received in the pedal mount (12) and are located within the base (21), the reciprocating pedal (22) and one erect wing (23). The pinion gear (31) is engaged with the arced rack (224). The first bevel gear (32) is fixedly and coaxially connected with the pinion gear (31). The pinion gear (31) and the first bevel gear (32) pivotally mounted on one of the erect wings (23) through the limit slot (223). The pinion gear (31) and the first bevel gear (32) may be integrally formed. The second bevel gear (33) is engaged with and axially perpendicular to the first bevel gear (32), is pivotally mounted on the base (21), and has a unidirectional bearing (331) therein. Given the structure of the transmission unit (3), when users step on the foot rest (221), stepping pressure first drives the pinion gear (31) engaged with the arced rack (224) to rotate and the first bevel gear (32) is synchronously rotated as it is fixedly mounted with the pinion gear (31), so as to drive the second bevel gear (33) to rotate. Hence, the vertical rotation of the arced rack (224) or the pinion gear (31) initiating from the stepping pressure of users is converted into the horizontal rotation of the second bevel gear (33).

The draining unit (4) is fixedly connected to the second bevel gear (33) and driven by the second bevel gear (33) to rotate unidirectionally. The draining unit (4) has a rod (41), a basket (42) and a water guard (43). One end of the rod (41) is sleeved by the unidirectional bearing (331) of the second bevel gear (33). A bottom of the basket (42) is centrally fixed with the other end of the rod (41) and is unidirectionally rotated by the second bevel gear (33). With reference to FIGS. 1, 2 and 6, the basket (42) is received in the chamber (11) and directly above the pedal mount (12) and has a ring wall and a plurality of through holes (421). A segment of the ring wall of the basket (42) faces a portion of an inner wall of the bucket (1) above the pedal mount (12).

The water guard (43) has two fixing parts (431), an arched wall (432), two fasteners (433) and a mop gripper (434). The two fixing parts (431) are respectively formed on two top edges of the water guard (43). The arched wall (432) is formed between the two fixing parts (431) and extends downwardly from the top edge of the water guard (43). The two fasteners (433) respectively extend downwardly from the two fixing parts (431) of the water guard (43). The two fixing parts (431) respectively correspond to the two recesses (15) of the bucket (1) so that the two fasteners (231) are respectively snapped into the two snap holes (16). The water guard (43) is located in the chamber (11) of the bucket (1), and externally surrounds the segment of the ring wall of the basket (42) facing the portion of the inner wall of the bucket (1) above the pedal mount (12). Therefore, the sputtered water of the mop placed inside the basket (42) is blocked by the water guard (43) and the portion of the inner walls of the bucket (1) and contained in the bucket (1) when the basket (42) is spinning. The mop gripper (431) is mounted on a periphery of the water guard (43) opposite to the basket (42) and has two arms (4311). A vertical sag (4312) is formed between the two arms (4311) of the mop gripper (431) and across the water guard (43).

Figure 8:
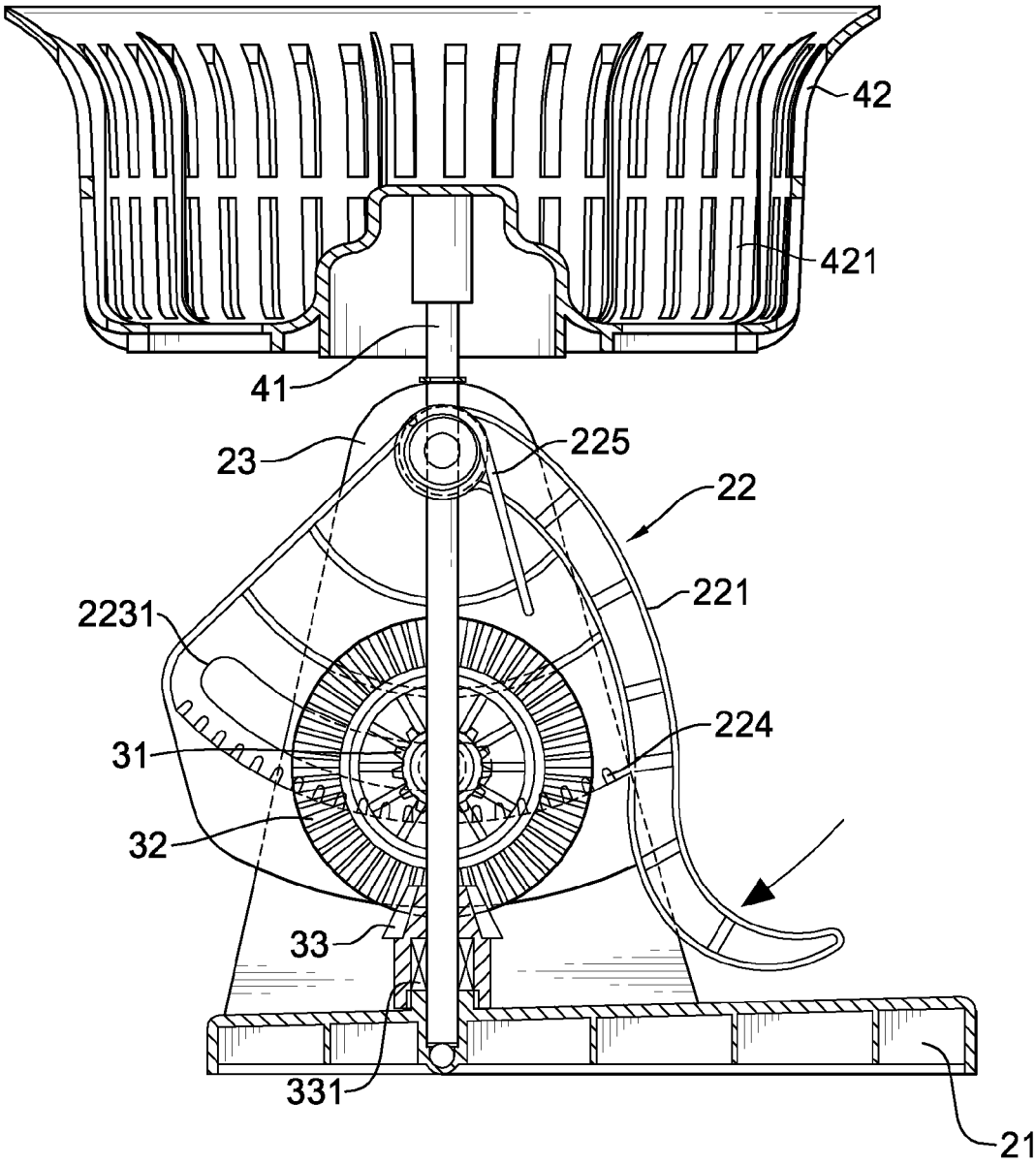
FIG. 8 is another cross-sectional view of the driving unit, the transmission unit and the draining unit of the mop strainer in accordance with the present invention.

With reference to FIGS. 7 and 8, when there is no force applied to the foot rest (221), the reciprocating pedal (22) is positioned at an upper location, and the limit slot (223) is stopped at a first end point (2231).

When straining, a mop is placed in the basket (42) first. After the foot rest (221) is stepped on, the sector wall (222) is pivoted, the limit slot (223) is stopped at a second end point (2232), and the reciprocating pedal (22) is positioned at a lower location. The pinion gear (31) is driven by the arced rack (224) to rotate. Since the pinion gear (31) is fixedly and coaxially connected with the first bevel gear (32), the first bevel gear (32) is also driven to synchronously rotate with the pinion gear (31). Then, the second bevel gear (33) is driven by the first bevel gear (32) to rotate the rod (41) and the basket (42). Given the process, the mop is strained.

When the foot rest (221) is not stepped, due to the effect of the torsion spring (225), the reciprocating pedal (22) is restored to the upper location when no force is applied to the foot rest (221) or the limit slot (223) will be finally stopped at the second end point (2232). As the arced rack (224) is pivoted by the restoring force, the pinion gear (31) and the first bevel gear (32) are driven to rotate, and the second bevel gear (33) is also driven by the first bevel gear (32) to rotate. Since the rotation of the second bevel gear (33) is reverse to that when the foot rest (221) is stepped and the unidirectional bearing (331) is mounted in the second bevel gear (33), the rod (41) and the basket (42) are not rotated so that the basket (42) always rotates in one direction to fully utilize the centrifugal force for draining a mop.

In sum, the mop strainer of the present invention employs the sector wall having reinforced ribs therein to prevent the reciprocating pedal from being easily fractured and damaged. The limit slot positions where the foot rest is located when the foot rest is stepped or released, so as to provide a comfortable stroke for users to operate. The T-shaped tail of the foot rest further limits the reciprocating pedal to move axially. The water guard attached on the basket further prevents drained water from sputtering upon spinning the basket. The mop gripper on the water guard for holding a mop provides an easy means to store the mop. As such, the present invention is more robust, convenient and practical in operation and storage.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A mop strainer, comprising:

a bucket comprising:

a chamber for receiving water; and a pedal mount formed into the bucket;

a driving unit mounted inside the pedal mount and comprising:

a base fixedly mounted on the bucket;

two erect wings mounted in parallel on the base; and a reciprocating pedal having:

a sector wall having two bevel edges, a limit slot formed therethrough, a recess formed in one side thereof, and multiple reinforced ribs formed on the recess;

an arced rack formed on a bottom of the recess of the sector wall and beneath the limit slot; and a foot rest horizontally extending from one of the two bevel edges of the sector wall, and having a first end pivotally mounted on the two erect wings;

a transmission unit received inside the pedal mount, located within the base, the reciprocating pedal and one erect wing, and having a gear assembly engaging the arced rack of the driving unit; and a draining unit fixedly connected to the gear assembly, driven thereby to rotate unidirectionally, and having a rod, one end of the rod sleeved by a unidirectional bearing of the gear assembly;

a basket received in the chamber of the bucket and having a ring wall, a bottom of the basket centrally fixed with the other end of the rod and is unidirectionally rotated by the gear assembly; and a water guard located in the chamber of the bucket, externally surrounding a segment of the ring wall of the basket facing a portion of an inner wall of the bucket above the pedal mount, and having a mop gripper extending from a periphery of the water guard opposite to the basket.

2. The mop strainer as claimed in claim 1, wherein the bucket further comprises a handle pivotally mounted on a top edge of the bucket.

3. The mop strainer as claimed in claim 1, wherein the foot rest takes a wavy form and has a second end limiting the foot rest to move in an axial direction.

4. The mop strainer as claimed in claim 1, wherein the transmission unit comprises:

a pinion gear engaging the arced rack;

a first bevel gear fixedly and coaxially connected with the pinion gear, and pivotally mounted together with the pinion gear on one of the erect wings through the limit slot; and a second bevel gear engaging and axially perpendicular to the first bevel gear, pivotally mounted on the base, and having said unidirectional bearing therein.

5. The mop strainer as claimed in claim 1, wherein the bucket further comprises a bottom board being a bottom of the bucket and having:

an uneven portion;

a raised portion raised above the uneven portion and located directly above the pedal mount; and multiple parallel ribs formed on the uneven portion.

6. The mop strainer as claimed in claim 2, wherein the bucket further comprises a bottom board being a bottom of the bucket and having:

an uneven portion;

a raised portion raised above the uneven portion and located directly above the pedal mount; and multiple parallel ribs formed on the uneven portion.

7. The mop strainer as claimed in claim 3, wherein the bucket further comprises a bottom board being a bottom of the bucket and having:

an uneven portion;

a raised portion raised above the uneven portion and located directly above the pedal mount; and multiple parallel ribs formed on the uneven portion.

8. The mop strainer as claimed in claim 4, wherein the bucket further comprises a bottom board being a bottom of the bucket and having:

an uneven portion;

a raised portion raised above the uneven portion and located directly above the pedal mount; and multiple parallel ribs formed on the uneven portion.

9. The mop strainer as claimed in claim 5, wherein the bucket further comprises two recesses formed on two opposite top edges thereof and two snap holes formed respectively in the two recesses; and the water guard further comprises:

two fixing parts respectively formed on two top edges thereof; and two fasteners respectively extending downwardly from the two fixing parts to snap into the corresponding snap holes.

10. The mop strainer as claimed in claim 6, wherein the bucket further comprises two recesses formed on two opposite top edges thereof and two snap holes formed respectively in the two recesses; and the water guard further comprises:

two fixing parts respectively formed on two top edges thereof; and two fasteners respectively extending downwardly from the two fixing parts to snap into the corresponding snap holes.

11. The mop strainer as claimed in claim 7, wherein the bucket further comprises two recesses formed on two opposite top edges thereof and two snap holes formed respectively in the two recesses; and the water guard further comprises:

two fixing parts respectively formed on two top edges thereof; and two fasteners respectively extending downwardly from the two fixing parts to snap into the corresponding snap holes.

12. The mop strainer as claimed in claim 8, wherein the bucket further comprises two recesses formed on two opposite top edges thereof and two snap holes formed respectively in the two recesses; and the water guard further comprises:

two fixing parts respectively formed on two top edges thereof; and two fasteners respectively extending downwardly from the two fixing parts to snap into the corresponding snap holes.

13. The mop strainer as claimed in claim 9, wherein the water guard further comprises:

two arms formed on the periphery of the water guard; and a vertical sag formed between the two arms of the mop gripper.

14. The mop strainer as claimed in claim 10, wherein the water guard further comprises:

two arms formed on the periphery of the water guard; and a vertical sag formed between the two arms of the mop gripper.

15. The mop strainer as claimed in claim 11, wherein the water guard further comprises:

two arms formed on the periphery of the water guard; and a vertical sag formed between the two arms of the mop gripper.

16. The mop strainer as claimed in claim 12, wherein the water guard further comprises:

two arms formed on the periphery of the water guard; and a vertical sag formed between the two arms of the mop gripper.

* * * * *